US005356240A

United States Patent [19]

Schuler

[11] Patent Number: 5,356,240

[45] Date of Patent: Oct. 18, 1994

[54] SOIL GAS AND MOISTURE REMOVAL

[76] Inventor: Joseph A. Schuler, 4500 Alma Lane, Nampa, Idaho 83686

[21] Appl. No.: 995,781

[22] Filed: Dec. 23, 1992

[51] Int. Cl.[5] ..... E02D 27/00; E04B 1/92

[52] U.S. Cl. ..... 405/229; 52/220.3; 405/128

[58] Field of Search ..... 405/128, 229, 129, 52; 52/220.3, 220.4, 220.5, 302.1, 169.5, 169.14

[56] References Cited

U.S. PATENT DOCUMENTS

| | | | |
|---|---|---|---|
| 1,715,474 | 6/1929 | Sherman | 52/220.3 X |
| 2,811,850 | 11/1957 | Clary | 52/223.3 X |
| 4,250,674 | 2/1981 | Feist | 52/220.3 |
| 4,798,034 | 1/1989 | Jarnagin et al. | 52/169.5 |
| 4,801,800 | 1/1989 | Scheible | 250/255 |
| 4,843,786 | 7/1989 | Walkinshaw et al. | 52/169.5 |
| 4,957,394 | 9/1990 | Jarnagin et al. | 405/128 |
| 4,988,237 | 1/1991 | Crawshaw | 405/229 |
| 5,003,750 | 4/1991 | Delgado | 52/742 |
| 5,003,865 | 4/1991 | Traudt | 98/1.5 |
| 5,054,252 | 10/1991 | Newman | 52/302.1 X |
| 5,067,852 | 11/1991 | Plunkett | 405/128 |
| 5,076,727 | 12/1991 | Johnson et al. | 405/128 |
| 5,120,160 | 6/1992 | Schwengel | 405/128 |
| 5,193,934 | 3/1993 | Johnson et al. | 405/128 |

*Primary Examiner*—Dennis L. Taylor
*Attorney, Agent, or Firm*—Frank J. Dykas; Craig M. Korfanta

[57] ABSTRACT

A system for removing soil gases, including radon, and moisture from the proximity of building foundations is disclosed. In one embodiment, a network of grooves is scored in the top surface of a cement slab foundation. Tubing with filtered openings for the inlet of gases and moisture is buried in the groove network with the openings at the top surface of the slab. The tubing is connected to a vacuum pump which discharges gases and moisture. When an impervious floor covering is placed on top of the cement slab, the vacuum system prevents blistering or bubbling and other failure of the flooring from accumulations of gases and moisture under it.

In another embodiment, an array of tubes connected to the vacuum system passes through basement walls and is buried in the soil in proximity to a building foundation. Fluid collectors are provided at the ends of the buried tubes for gases and moisture diffusing into the collectors from the soil.

12 Claims, 2 Drawing Sheets

SOIL GAS AND MOISTURE REMOVAL

BACKGROUND OF THE INVENTION

1. Technical Field

The present invention generally relates to methods for reducing levels of immunogenic and/or toxic substances in the indoor air of houses, commercial buildings and the like. In some of its more preferred embodiments, this invention also relates to reducing pressure and moisture under sealed floor coverings of such buildings to prevent blistering or bubbling of the coverings.

2. Background Art

Failure of flooring systems, especially vinyl and other impervious materials applied over a cement slab, such as in churches and gymnasiums, have left many floors in an unusable condition. Contributing factors to failure include water or moisture attaching to the adhesive used, incorrect or incomplete vapor barrier, and inappropriate fill provided below the slab.

Jarnagin et al., U.S. Pat. No. 4,798,034, discloses collecting and discharging radon gas from a basement with a sealed conduit vacuum system around the inside bottom perimeter of the basement.

Scheible, U.S. Pat. No. 4,801,800, discloses a forced air sample collection unit for a radon gas analyzer. Walkinshaw et al., U.S. Pat. No. 4,843,786, discloses a ventilated cavity around a basement for exhausting soil gases and draining soil moisture.

Jarnagin et al., U.S. Pat. No. 4,957,394, discloses collecting and discharging radon gas from a basement with a vacuum system in a sump or drain.

Crawshaw, U.S. Pat. No. 4,988,237, discloses collecting radon gas from a cavity beneath a floor slab and exhausting it to the atmosphere.

Delgado, U.S. Pat. No. 5,003,750, discloses collecting soil gases from a gravel bed beneath a foundation, and venting them to the atmosphere.

Traudt, U.S. Pat. No. 5,003,865, discloses a control system for house ventilation which accounts for the soil gas pressure beneath the foundation.

Accordingly, it is objective of the present invention to overcome limitations and disadvantages of the prior art.

It is another object of the present invention to provide a method and apparatus for collecting and discharging both soil gases, including radon, and moisture from beneath a floor covering.

It is another object of the present invention to provide a method and apparatus for collecting soil gases, including radon, and moisture from zones outside a building enclosure and discharging them before they accumulate inside the enclosure.

It is another object of the present invention to create a negative pressure beneath a sealed floor covering or outside a sealed wall in order to prevent the accumulation of soil gases, including radon, and moisture next to the floor covering or wall.

It is another object of the present invention to collect soil gases, including radon, and moisture from areas where conventional fans or sump pumps may not be convenient or practical.

It is another object of the present invention to deliver soil gases, including radon, and moisture collected by vacuum to a remote compressor or pump for disposal.

DISCLOSURE OF INVENTION

Whatever the cause of flooring system failure, soil gas and moisture found between floor covering and cement slab must be controlled in an economical manner. My experience suggests that creating a negative pressure, or a vacuum, beneath the floor covering not only relieves the area of moisture and gases, but pulls and maintains the covering tight to the cement slab surface.

Consequently, my invention is an apparatus and a method for providing a vacuum between a floor covering and a supporting cement slab. The vacuum acts to collect and remove soil gases, including radon, and moisture from between the floor covering and the slab. Also, the vacuum may be provided outside basement walls in proximity to a foundation.

The vacuum is provided by a vacuum pump which exhausts the collected gases and moisture to the atmosphere. In one embodiment of my invention, the pump is connected to a manifold of tubing which lays on or in the surface of the concrete slab, but beneath a floor covering on the slab. At several discrete places in the manifold, filtered openings are provided to permit the inlet of soil gases and moisture for collection and discharge. In a preferred embodiment of my invention, the manifold system is laid in grooves cut in the surface of the cement, and fluid collectors are maintained below or flush with the top surface of the slab, so that no bumps appear in the floor covering. Also, additional and optional equipment may be provided, including a vacuum reservoir, and a condensate trap and pump-out assembly, in the line between the inlet manifold and the vacuum pump.

In another embodiment of my invention, the vacuum pump is connected to a manifold of tubing which is buried in the ground outside the submerged wall of a building basement or foundation. Again, at several places in the manifold, discrete filtered openings are provided to permit the inlet of soil gases and moisture for collection and discharge.

Because different levels of vacuum may be needed in different areas under the floor covering or around the foundation, a manifold system with adjustable valves is preferably incorporated for zone vacuum control. A vacuum pump is preferred in lieu of a fan in these embodiments because the small manifold lines (generally cylindrical tubing, about $\frac{1}{4}'$ diameter) used may be up to about 100' in length, resulting in too high a pressure drop for fan applications.

BEST MODE FOR CARRYING OUT INVENTION

Figure 1:
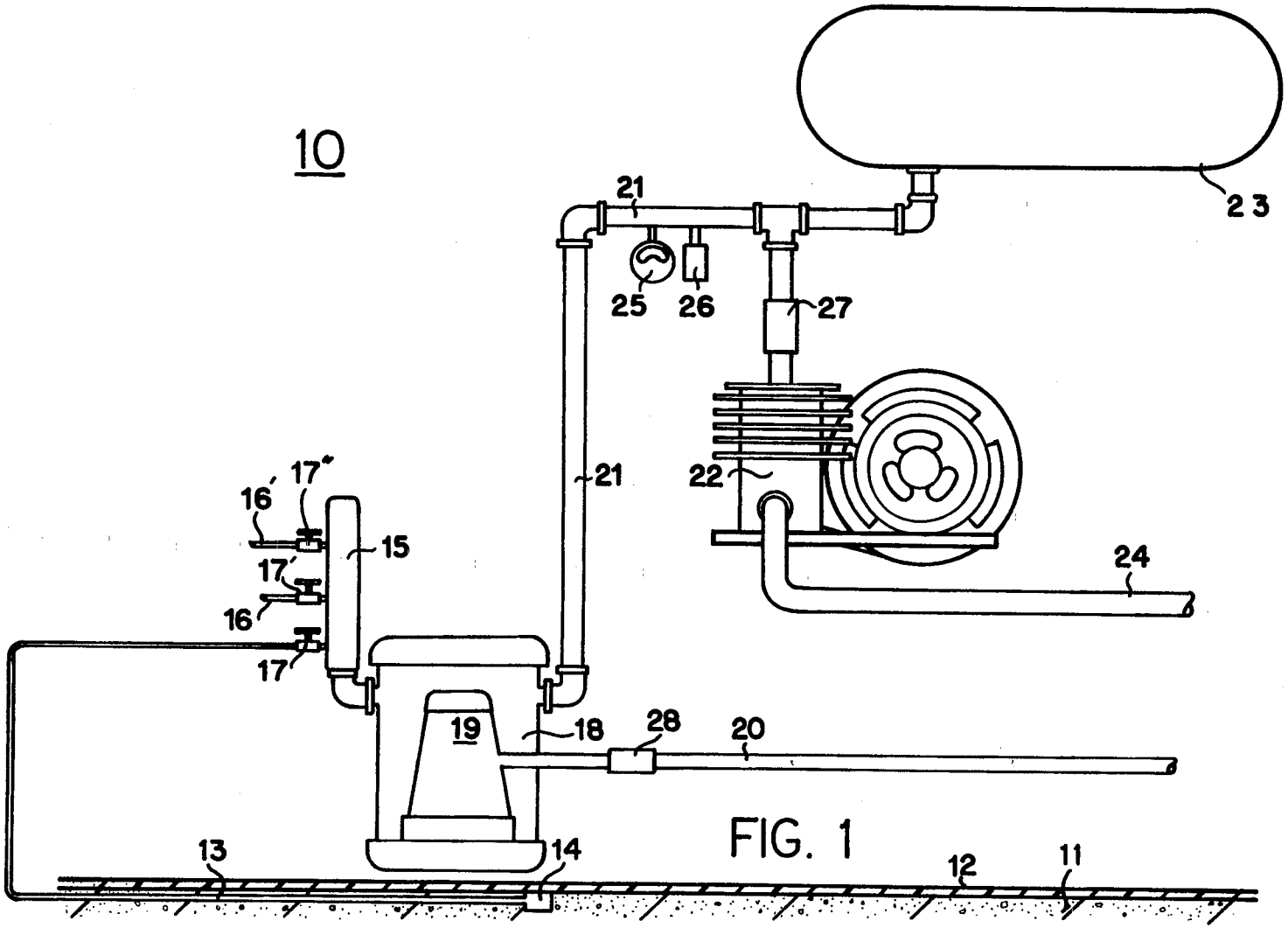
FIG. 1 is a schematic, partially cross-sectional flow diagram of one, preferred embodiment of my invention.

Referring to FIG. 1, there is depicted a schematic, partially cross-sectional flow diagram of one, preferred embodiment 10 of my invention. On cement slab 11 is secured vinyl floor covering 12. In slab 11 is buried tube 13 which connects filtered opening 14 to manifold 15. Other tubes 16 and 16' are also connected to manifold 15. This way, an array or network of tubes with filtered openings may be provided between slab 11 and floor covering 12 over the top surface of the slab. Control valves 17, 17' and 17'' may be provided to permit adjustment of the relative vacuum in different tubes and therefore, different zones of the network of tubes between slab 11 and floor covering 12.

Manifold 15 is connected to condensate trap 18 which has pump-out assembly 19 and condensate discharge line 20 connected to its liquid side for removal of water and other fluids which condense in trap 18. Condensate trap 18 is also connected on its gas side to vacuum inlet line 21 which, in turn, is connected to vacuum pump 22. Also connected to vacuum inlet line 21 is vacuum reservoir 23. On the outlet side of vacuum pump 22 is gas discharge line 24 for ultimate removal of gases which initially come into the vacuum system through openings 14.

Optionally, vacuum reservoir 23 may be used to stabilize the vacuum level. Also, optional gauge 25, vacuum controller 26 and check valves 27 and 28 may be used for ease of system operation.

Soil gases, including radon, and moisture diffuse up out of the ground and through cement slab 11. If these gases and moisture are not collected and removed, they tend to accumulate at the interface between the top surface of cement slab 11 and the bottom surface of floor covering 12. There, they may become concentrated and produce blistering and bubbling, or other failure of the floor covering 12.

In my invention, discrete collectors are positioned at this interface between the top surface of the cement slab 11 and the bottom surface of floor covering 12. By "discrete" I mean separate and distinct, characterized by individual, different collectors. The collectors are 10 preferably openings 14 in tube 13 which is positioned on or in cement slab 11. Preferably, openings 14 are protected by filters to prevent them and tube 13 from being plugged with debris. Tube 13 may be copper or plastic cylindrical tubing about ¼" in diameter for most applications. Opening 14 may simply be an open end of tube 13, or an intermediate opening cut into its side. By "intermediate" I mean between the beginning and end of the tube 13, that is, not on its end. I used ⅝" diameter, ¾" long brass filters to cover end openings 14.

I used a masonry saw to score a network of grooves about ¾" deep in the bare concrete slab 11. Preferably, the groove network is a rectangular grid covering the slab in about 10' squares. Then, I carefully inserted the tubing 13 in the grooves, and backfilled the grooves with the tubing inserted in them with FIX-ALL TM or similar masonry material to bury the tubing and smooth the surface of the slab. Collectors, including filtered openings 14, are positioned so that they lay flush with the top surface of the smoothed cement slab 11. I prefer that the collectors be uniformly distributed throughout the groove network grid, approximately 15' apart. I exercised care to ensure that openings 14 were clean and open to the top surface of slab 11. Then, I laid the floor covering, for example, an impervious vinyl, on the top surface of slab 11, secured it to the slab with an adhesive, and carefully sealed it at its perimeter by the walls of the building.

Then, I connected the tubing 13 ends to the manifold 15 which was installed in a crawl space of the building. I turned on the vacuum pump and began to withdraw soil gases and moisture from beneath the floor covering.

Figure 2:
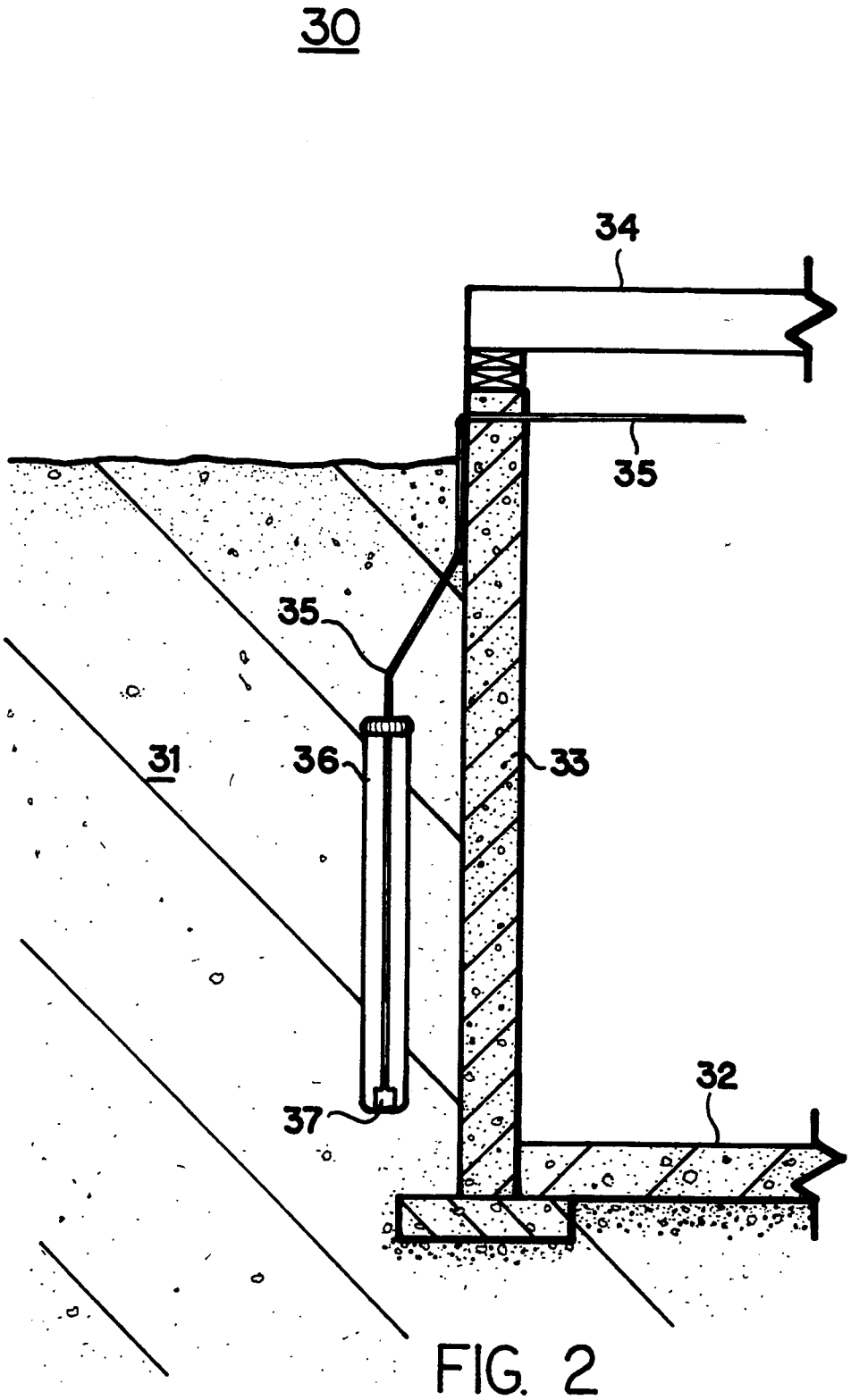
FIG. 2 is a schematic, partially cross-sectional flow diagram of another embodiment of my invention.

Referring to FIG. 2, there is depicted generally an alternative embodiment 3.0 of my invention. In this embodiment soil 31 surrounds building foundation basement floor 32 and basement wall 33. Floor support 34 rests on foundation wall 33. Tube 35 extends through a hole in wall 33 from the outside to the inside of the building's basement. Outside wall 33, tube 35 extends down into the soil 31. There, tube 35 is connected to soil gas and moisture collector 36. Preferably, collector 36 is a porous cylinder which permits soil gases and moisture to pass into its interior. There, tube 35 is connected to filtered opening 37. A plurality of tubes 35 may extend outside the building and be arranged in an array in order to provide soil gas and moisture inlet points at many locations outside the foundation. This way, when tubing 35 is connected to a vacuum system like that described above relative to FIG. 1, soil gases, including radon, and moisture may be collected from outside the foundation floor 32 and wall 33, and prevented from entering the building.

While there is shown and described the present preferred embodiment of the invention, it is to be distinctly understood that this invention is not limited thereto but may be variously embodied to practice within the scope of the following claims.

I claim:

1. A soil gas and moisture removal apparatus comprising:

a vacuum-producing means;

an array of conduits connected to and in fluid communication with said vacuum-producing means, said conduits being a network of grooves in a cement slab foundation of a building; and a plurality of fluid collectors, each collector being connected to and in fluid communication with at least one of said conduits, said collectors being located at discrete points in said conduits, said collectors being located below or flush with the top surface of said cement slab foundation and covered with a floor covering.

2. The apparatus of claim 1 wherein the conduits are cylindrical tubing.

3. The apparatus of claim 1 wherein the fluid collectors are the holes at the open ends of tubing.

4. The apparatus of claim 1 wherein the fluid collectors are holes in the intermediate sides of tubing.

5. The apparatus of claim 1 wherein the fluid collectors are covered with a filter.

6. The apparatus of claim 1 wherein the fluid collectors and the cement slab are covered with an impervious floor covering.

7. A means for enhancing the adhesion of an impermeable floor covering to a flooring substrate comprising: a vacuum producing means;

an array of conduits being recessed in the flooring substrate directly beneath and in contact and in fluid communication with an underside of the floor covering, the conduits also being connected to and in fluid communication with said vacuum producing means; and a plurality of fluid collectors, each collector being connected to and in fluid communication with at least one of said conduits, said collectors being located at discreet points in said conduits.

8. The apparatus in claim 7 wherein the conduits are formed of tubing.

9. The apparatus of claim 8 wherein the fluid collectors are holes at the open ends of tubing.

10. The apparatus of claim 9 wherein the fluid collectors are holes in the intermediate sides of tubing.

11. The apparatus of claim 10 wherein the fluid collectors are covered with a filter.

12. The apparatus of claim 10 wherein the fluid collectors are covered with a filter.

* * * * *